US005344068A

United States Patent [19]

Haessig

[11] Patent Number: 5,344,068

[45] Date of Patent: Sep. 6, 1994

[54] DYNAMICALLY CONTROLLED ENVIRONMENTAL CONTROL SYSTEM

[75] Inventor: David L. Haessig, Poway, Calif.

[73] Assignee: Staefa Control System, Inc., San Diego, Calif.

[21] Appl. No.: 48,494

[22] Filed: Apr. 16, 1993

[51] Int. Cl.[5] ..... F24F 7/00

[52] U.S. Cl. ..... 236/47; 236/51

[58] Field of Search ..... 236/47, 46 R, 51; 165/11, 1, 12

[56] References Cited

U.S. PATENT DOCUMENTS

| | | | |
|---|---|---|---|
| 4,223,831 | 9/1980 | Szarka | 236/47 |
| 4,462,540 | 7/1984 | Dytch | 236/47 |
| 4,623,969 | 11/1986 | Bensoussan | 236/47 X |
| 4,997,029 | 3/1991 | Otsuka et al. | 165/11.1 |
| 5,088,645 | 2/1992 | Bell | 165/11.1 X |
| 5,127,575 | 7/1992 | Beerbaum | 236/47 X |

*Primary Examiner*—William E. Wayner
*Attorney, Agent, or Firm*—Bernard L. Kleinke; Jerry R. Potts

[57] ABSTRACT

An environmental control system includes a plurality of electronically controlled zone controllers mounted on local VAV boxes for regulating the lighting, temperature and ventilation in a plurality of small zone areas. Each zone controller includes a timer which may be adjusted dynamically to change environmental requirements for zone occupants. A remote master computer is coupled to each local controller to provide three modes of lighting and HVAC equipment control. The inventive method of using the system includes controlling selectively individual ones of the zone controllers to provide three modes of operation an OCCUPIED mode, a STANDBY mode, and an UNOCCUPIED mode where the time period for each mode is adjustable either locally from the zone or remotely from a remote console.

21 Claims, 5 Drawing Sheets

DYNAMICALLY CONTROLLED ENVIRONMENTAL CONTROL SYSTEM

CROSS REFERENCE TO RELATED APPLICATIONS

This application is related to copending U.S. patent application Ser. No. 08/048,474 filed concurrently herewith and to U.S. Pat. No. 4,942,921 filed Jan. 29, 1988 and U.S. Pat. No. 5,005,636 filed Feb. 5, 1990, assigned to the same assignee. The above referenced patents and patent application are incorporated herein by reference.

Technical Field

The present invention relates in general to an environmental control system, and it more particularly relates to an improved environmental control system which is dynamically adjustable for changing air temperature and lighting requirements in at least one building zone for energy conservation purposes.

Background Art

Efficient zone air temperature and lighting control is one of the most important energy conservation measures available to modern office building facilities. Energy costs include the cost of electrical power to provide illumination, plus the cost to operate high volume air conditioning (HVAC) equipment to remove heat generated by the lighting equipment. In this regard, for every dollar spent on lighting power, an additional thirty cents is spent to remove heat. Thus, automatic lighting control is an important element of an energy efficient lighting system.

Therefore, it would be highly desirable to have a new and improved environmental control system that automatically controls the air temperature and lighting requirements for a modern day office building facility.

Several modern environmental control systems provide for such air temperature and lighting control through separate systems. For example, U.S. Pat. Nos. 4,942,921 and 5,005,636 discloses air temperature control systems for regulating the air temperature in a large number of controlled zones for energy saving purposes. Similarly, lighting control systems have been employed for keeping lights turned off during non-scheduled working periods, such as at late night and over weekends.

Modern lighting controls go beyond merely keeping lights out at night and over weekends. In this regard, modern lighting control is occupancy sensitive that allows power consumed by lights and HVAC equipment in unused or UNOCCUPIED zones to be reduced during scheduled working hours. Thus, occupancy sensitive lighting offers the facility operator a solution to peak cooling load problems introduced by new indoor air quality and refrigerant regulations. In this regard, during peak cooling periods, one hundred percent of the energy consumed for lighting must be removed by the cooling system. Thus, occupancy sensitive lighting systems are highly desirable.

While occupancy sensitive lighting systems have been available for controlling facility lighting such systems have proven less than satisfactory, in that they have introduced other problems. In this regard, typical building occupancy is highly variable factor depending upon working hours, deadline schedules, employee work habits, holidays, and weather conditions. Thus, in order to achieve maximum energy efficiency a building operator must adjust zone time interval delays repeatedly. Such activity is not only time consuming, but it is also awkward, and very expensive.

Therefore, it would be highly desirable to have a new and improved environmental control system that would not require repeated adjustments to achieve maximum energy efficiency. Such a system should also be relatively inexpensive to install and maintain.

One attempt at solving the above mentioned problem has been to install a remote console for controlling and adjusting occupancy-sensitive time intervals. While such a remote console facilitates easier adjustment, remote consoles are relatively expensive to install and maintain. In this regard, a building operator must support two systems, one for controlling the HVAC equipment and one for controlling the lighting. Supporting two systems has proven to be very expensive including not only the initial purchase costs, but also ongoing costs for maintenance, operator training as well as space costs for housing the individual consoles.

Therefore, it would be highly desirable to have a new and improved environment control system for controlling air temperature and lighting that does not require multiple remote consoles.

Occupancy-sensitive lighting systems have also proven less than totally satisfactory as it has been difficult to optimize energy saving opportunities. In this regard, conventional occupancy lighting system traditionally control large areas of a facility. Thus, while such systems provide energy savings, they fail to optimize the energy savings opportunity. For example, if only one person is working on a floor of a high rise building, conventional lighting schemes may control one-fourth of the entire floor, while only one office is being used.

Therefore, it would be highly desirable to have a new and improved environment control system that provides control of small lighting zones concurrent with the HVAC zones.

Disclosure of Invention

Therefore, it is the principal object of the present invention to provide a new and improved environmental control system to adjust dynamically air temperature and lighting requirements for a modern day high rise or similar facility.

Another object of the present invention is to provide such a new and improved environmental control system to improve substantially energy savings by providing small lighting zones concurrent with associated HVAC zones in a relatively inexpensive, cost efficient manner.

A further object of the present invention is to provide such a new and improved environmental control system for facilitating air temperature and lighting control from a single remote console.

Briefly, the above and further objects of the present invention are realized by providing a new and improved environmental control system to adjust concurrently the air temperature and lighting requirements of a large number of small zones within a facility and includes an integrated remote control console to help improve energy savings by providing a desired balance between saving energy and providing comfort based on occupancy of the space.

An environmental control system includes a plurality of electronically controlled zone controllers mounted on local variable air volume (VAV) boxes for regulating the lighting, temperature and ventilation in a plurality of small zone areas. Each zone controller includes a timer which may be adjusted dynamically to change environmental requirements for zone occupants. A remote master computer is coupled to each local controller to provide three modes of lighting and HVAC equipment control.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
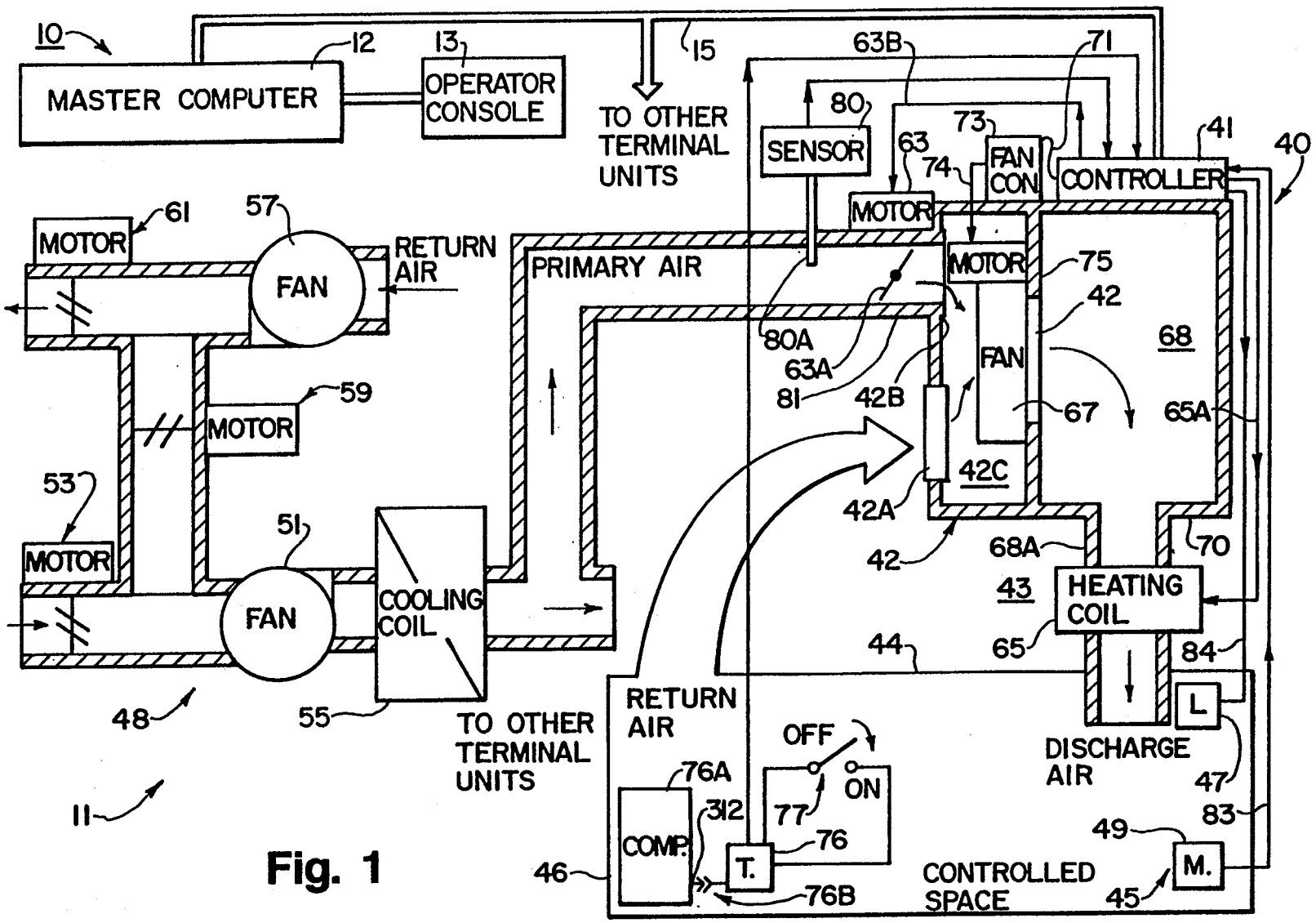
FIG. 1 is a symbolic block diagram of an environmental control system which is constructed in accordance with the present invention.

Referring now to the drawings, and more particularly to FIG. 1, there is shown an environmental control system 10, which is constructed in accordance with the present invention and which is illustrated being installed within a building 11. The building 11 is divided into a large number of small zones or controlled spaces, such as a controlled space 46, for energy conservation purposes.

The environmental control system 10, includes a master field network controller or computer 12 having a single operator console, such as a personal computer 13 for controlling building cooling and lighting requirements by scheduling zone occupancy. Each zone, such as the controlled space 46, includes a terminal unit, such as a terminal unit 40, responsive to the master computer 12 for controlling zone cooling and lighting requirements. In this regard, the terminal unit 40 includes a controller 41 having a software timer 41A responsive to the master computer 12, via a buss 15, for controlling the heating, cooling and lighting requirements of the space 46.

Each space, such as the space 46 includes a lighting arrangement, such as a lighting arrangement 45 for supplying artificial light within the space 46 through the individual terminal units, such as the terminal unit 40.

A variable air volume arrangement 42, having a housing 70 is mounted in a plenum space 43 above a ceiling 44 of the controlled space 46, conditions the air within the space 46. The lighting arrangement 45, which is mounted within the space 46, supplies the space 46 with artificial lighting based upon scheduling and zone occupancy. In this regard, the lighting arrangement 45 includes at least one set of lights, such as a lighting set 47, and a motion sensor or proximity detector 49 for detecting when the controlled space 46 is occupied by one or more occupants.

Additionally, a service tool, such as a portable computer 76A, can be connected electrically to a temperature sensor 76 via a jack 76B, for sending information to the controller 41. In this regard, the service tool 76A can set minimum and maximum flow rates for the arrangement 42 or time out periods for the lighting conditions in the space 46. It should be understood that different adjustments can be made, either under the control of the service tool 76A or the master computer 12 which is connected directly to the controller 41 via the buss 15.

Considering now the operation of the environment control system 10 in greater detail with reference to FIG. 1, the master computer 12 controls the individual terminal units, such as the terminal unit 40 based upon occupancy. In this regard, there are three occupancy modes of operation that may be selected by either an integral system time scheduler 100 or a maintenance person (not shown) via the service tool 76A. Appendix A provides a complete source code listing for scheduler 100.

The three occupancy modes of operation are shown in Table I as an OCCUPIED mode, a STANDBY mode, and an UNOCCUPIED mode. In the STANDBY mode and the UNOCCUPIED mode, the motion sensor 49 generates a signal indicative of an occupant entering or moving within the space 46 to cause the controller 41 to activate the light set 47 within the space 46.

TABLE I

| | |
|---|---|
| OCCUPIED | Determined when occupants are in a controlled space during scheduled work periods. |
| STANDBY | Determined when a controlled space is occupied during scheduled periods. |
| UNOCCUPIED | Determined when a controlled space is scheduled for nonoccupancy during overnight and weekend periods. |

When a controlled space, such as space 46, is occupied, the controller 41 causes the temperature and ventilation within the space 46 to be regulated to provide a productive and healthy environment. When the space 46 is not occupied, the controller 46 maximizes energy conservation.

Table II illustrates the condition of the variable air volume arrangement 42 during the three occupancy modes of operation.

TABLE II

| | |
|---|---|
| OCCUPIED | Controller 41 causes the temperature in the space 46 to be precisely controlled to occupied setpoints and ventilation rates to ensure indoor air quality. |
| STANDBY | The space 46 may be occupied at any time. Accordingly, temperature setpoints are precisely controlled to the occupied setpoints. Ventilation is reduced or eliminated to help save energy and prevent overcooling of the space 46. |
| UNOCCUPIED | Controller 41 causes the temperature in the space to be controlled to unoccupied setpoints. Ventilation is eliminated to save energy. |

In order to condition a space, such as the space 46, for morning occupancy, the system time scheduler 100 activates the individual terminal units, such as the terminal unit 40, as well as the primary air system 48. In this regard, a recovery period is required to obtain heating or cooling comfort after a controlled space, such as the space 46, has been in an UNOCCUPIED state. Recovery is achieved by the master computer 12 optimizing start/stop functions to set each zone to a STANDBY state.

Lighting for each of the controlled spaces, such as the controlled space 46, is also controlled for the three occupancy modes of operation. In this regard, in the OCCUPIED mode full lighting is provided by the lighting set 47. In the STANDBY mode, the lighting set 47 is dimmed to a minimum lumination level to maintain safety and psychological security. In this regard, the dimmed lighting condition is defined as activating one half or less of the lights available in the space, such as the space 46. Thus, if a space included two or three lights, only one light would be illuminated in the STANDBY mode. In the UNOCCUPIED mode all lighting is extinguished.

It should be understood however, that either the master computer 12 or the space computer 76A can cause selected individual ones of the controllers, such as the controller 41, to override lights, such as the lights 47, to dim or to fully on for cleaning or security activities.

Considering now the override function provided by switch 77 in greater detail, the override function provides lights and comfort whenever a space, such as the space 46 is in use. This function is called by the computer 76A or the zone mounted override device 77. Operation of the override device 77 provides lights and comfort during normal working hours and lights and comfort for a predetermined override period during nonworking hours.

After morning warmup, individual spaces, such as the control space 46, are left in the STANDBY mode until the occupant arrives. Operation of the override device 77 signals the controller 41 to provide lights and comfort for the rest of the day.

In some applications, the override device 77 may also be used to turn lights and comfort air conditioning off. This feature allows the override device 76A to appear and function as a common light switch during normal working hours and as a time limited override during non working hours.

At the end of the work day, the lights are flashed once presignaling that light and air conditioning will be turned off in three minutes. If an occupant desires to stay, the override device 77 may be operated to provide lights and air conditioning for the length of the override.

When the occupant enters the controlled space, such as the space 46 at night, operation of the override device 77 provides lights and comfort for the occupancy. At the end of any override period, the lights will be flashed presignaling that lights and air conditioning will be turned off. The occupant may again operate the override device or leave the work place.

Considering now the operation of the system 10, each zone controller, such as the zone controller 41 is downloaded from the master computer 12 with a given energy conversation schedule based upon occupant utilization of the zone, such as the space 46. Each zone energy conservation schedule is unique and considers space utilization during scheduled and non-scheduled working hours.

As will be described herein in greater detail, the motion detector 49 generates a pulse signal which is coupled to the zone controller timer, such as the timer 41A. The timer 41A is a retriggerable timer which is reset to a predetermined count-down time period each time a pulse is received from the motion detector 49. Thus, if the count-down period is set for 5 minutes for example, each time a pulse is received the timer 41A will be reset to its 5 minute count-down period.

From the foregoing, it should be understood, that so long as an occupant moves within the space 46 at least once during the predetermined time period, the timer 41A will be reset.

In operation, when an occupant arrives at a zone, such as the space 46, the motion detector 49 generates a pulse causing the controller timer, such as the timer 41A, to be reset to its predetermined count-down time period. When the timer 41A is not at zero, the controller 41 causes the lighting arrangement 45 to be activated for supplying the space 46 with artificial light. In this regard, the space 46 will be illuminated with the maximum amount of artificial light available from the lighting arrangement 45.

In order to provide optimized energy savings, the energy conservation schedule causes the count-down timer 41A to be set to predetermined time periods that help prevent false triggering or shut-downs relative to occupant activity. In this regard, nighttime settings for the timer 41A are substantially shorter than daytime periods because during nighttime hours any activity within a zone usually is caused by cleaning or janitor personnel who are very active.

During daytime or normal working hours, a person within an office may sit at his or her desk reading a document for example, for several minutes before moving. Thus, to prevent false shut-downs during daytime hours, the time settings are typically set to longer periods of time.

Table IV is a typical schedule for an individual space, such as the space 46. In this regard, the master computer 12 may download operating schedules or commands to each controller, such as the controller 41. Controllers may share the same schedule or have a unique schedules depending upon occupant requirements. The primary objective of scheduling is to conserve energy and to help prevent false accidental switching from OCCUPIED/STANDBY modes to UNOCCUPIED modes.

The timing schedule of Table IV is illustrative to accommodate the use requirements of a given occupant. The nighttime setting 1800 hours to 0700 hours are short as cleaning activities may be scheduled. Cleaning people create more motion in the individual spaces and typically do not remain in any given space for an extended period of time.

During normal working hours (0800–1700) the time period of the timer is extended because office workers create much less motion and are in given spaces, such as the space 46 for longer periods of time.

To further optimize energy savings, the timer may be reduced during periods where an office worker is more active, such as a lunch period or a break.

TABLE IV

| DAYS/ HOURS | TIMER SETTINGS (MINUTES) | | | | | | |
|---|---|---|---|---|---|---|---|
| | MON | TUE | WED | THU | FRI | SAT | SUN |
| 0000 | 2 | 2 | 2 | 2 | 2 | 2 | 2 |
| 0100 | 2 | 2 | 2 | 2 | 2 | 2 | 2 |
| 0200 | 2 | 2 | 2 | 2 | 2 | 2 | 2 |
| 0300 | 2 | 2 | 2 | 2 | 2 | 2 | 2 |
| 0400 | 2 | 2 | 2 | 2 | 2 | 2 | 2 |
| 0500 | 2 | 2 | 2 | 2 | 2 | 2 | 2 |
| 0600 | 5 | 5 | 5 | 5 | 5 | 5 | 5 |

TABLE IV-continued

| DAYS/ HOURS | TIMER SETTINGS (MINUTES) MON | TUE | WED | THU | FRI | SAT | SUN |
|---|---|---|---|---|---|---|---|
| 0700 | 5 | 5 | 5 | 5 | 5 | 5 | 5 |
| 0800 | 10 | 10 | 10 | 10 | 10 | 15 | 15 |
| 0900 | 15 | 15 | 15 | 15 | 15 | 15 | 15 |
| 1000 | 15 | 15 | 15 | 15 | 15 | 15 | 15 |
| 1100 | 10 | 10 | 10 | 10 | 10 | 15 | 15 |
| 1200 | 5 | 5 | 5 | 5 | 5 | 15 | 15 |
| 1300 | 10 | 10 | 10 | 10 | 10 | 15 | 15 |
| 1400 | 15 | 15 | 15 | 15 | 15 | 15 | 15 |
| 1500 | 15 | 15 | 15 | 15 | 15 | 15 | 15 |
| 1600 | 10 | 10 | 10 | 10 | 10 | 15 | 15 |
| 1700 | 10 | 10 | 10 | 10 | 10 | 2 | 2 |
| 1800 | 5 | 5 | 5 | 5 | 5 | 2 | 2 |
| 1900 | 5 | 5 | 5 | 5 | 5 | 2 | 2 |
| 2000 | 5 | 5 | 5 | 5 | 5 | 2 | 2 |
| 2100 | 5 | 5 | 5 | 5 | 5 | 2 | 2 |
| 2200 | 2 | 5 | 5 | 5 | 5 | 2 | 2 |
| 2300 | 2 | 2 | 2 | 2 | 2 | 5 | 5 |

The time periods programmed into each local controller, such as the controller 41, is adjustable from 1 second to 255 minutes. This time period may be set remotely by a service operator from the console 13 or by a service operator within the space 46 via the service tool 76A.

To further conserve energy during those periods when a given space, such as the space 46, will be unoccupied the master computer programs each timer, such as timer 41A to a short period, such as a two minute period and places the controller 41 in an unoccupied mode state. Thus, all lights and air conditioning within the space 46 will be turned off.

During those periods when janitor or security personnel may be scheduled to visit a given space, such as the space 46, the timer 41A will be set to a short period, such as two minutes, but the controller will be placed in a STANDBY mode. In this regard, instead of the air conditioning and lights being completely turned off, they will be set to occupied temperature and minimum luminance levels. Thus, a space will not be cold and completely dark when the janitor or security persons enter the space. Moreover, once the person enters the space, the motion detector will cause the controller to activate the lighting set 47 to its full luminance level.

From the foregoing, it should be understood that the predetermined time periods may be dynamically set by time function or other events. This permits the time period to be reduced to optimize energy saving opportunities based upon occupant use of the controlled space 46. In this regard, the time period may be increased during normal working hours to reduce false turn off or shut-down conditions. Also, lights are dimmed when the space 46 is vacated during the day time scheduled hours. Lights are turned off when the space 46 is vacated during the evening non-scheduled hours.

Considering now the system 10 in greater detail, the system 10 includes a primary air system 48 for supplying cold air through the individual terminal units, such as the terminal unit 40, to the individual controlled spaces, such as the space 46. The primary air system 48 includes a primary air fan 51 which draws air from a mixed air plenum or duct through a motor-driven damper arrangement 53 and 59, and which discharges it through a cooling coil 55 to supply cool primary air to the terminal units, such as the terminal unit 40. Thus, the cooled primary air flows into the series connected terminal units, such as unit 40 for each space, such as the space 46. The other terminal units are not shown, but are similar to unit 40.

A return air fan 57 draws air returned from the spaces being conditioned, and discharges it through the motor driven damper 59 and into the inlet of the fan 51 for mixing with entering outside air. Also, a motor driven damper 61 discharges return air from the discharge of fan 57, to the outside environment when required.

Considering now the variable air volume arrangement 42 in greater detail, the arrangement 42 includes a motor driven damper 63 for admitting the primary air under pressure into an inlet of a series connected terminal fan 67. The terminal fan 67 draws both the primary air under pressure via an inlet 42B, and air returned from the space 46 via an inlet 42A. A chamber 42C of the arrangement 42 houses the fan 67, and includes the inlets 42A and 42B. The series fan 67 discharges air via an outlet 42D of the chamber 42C, into the interior of an adjacent chamber 68 of the arrangement 42, and from there, the air flows out of an outlet 68A of the chamber 68, through a heating coil 65 and into the space 46. The heating coil is optional, and thus, may be omitted, if desired.

The return air drawn from the space 46 can either be from the interior of the plenum above the ceiling 44, or it can be guided by duct (not shown). The discharge of the fan 67 is directed into the chamber 68 within the terminal 40 for causing the flow of primary air and return air to enter the controlled space 46 via the heating coil 65. Thus, the cold primary air is mixed by the fan 67 with the return air from the space 46, and the mixed air is heated, if required, by the heating coil 65, prior to being discharged into the space 46.

It should be understood that the primary air system 48 supplies a variable volume of cooled air which is distributed to each of the terminal units, such as the terminal unit 40, the volume of air available to each of the terminal units is of variable quantity depending upon the demand requirements of each of the terminal units.

The controller 41 is mounted outside of the housing 70 of the terminal unit 40, which in turn is disposed in relatively close proximity to the space 46. The controller 41 monitors continuously a set of variable conditions of the air in the space 46, the volume of primary air available to the terminal unit 40, the condition of the air in the space 46, and the presence or lack of presence of individuals within the space 46. The controller 41, generates a continuously varying control signal indicative of a desired quantity of cooled primary air under pressure required for mixing with return air from the controlled space 46 in mixing chamber 68 for the purpose of conditioning the air in the space 46 to a desired temperature. A fiberoptic link or light conduit 71 is interconnected between the controller 41 and a fan control unit 73 forming part of the variable air volume arrangement 42.

The fan control 73 is also mounted on the outside of the housing 70 above the fan 67 mounted on the inside of the housing 70 within the chamber 42C. The fan control 73 responds to the control signals received from the controller 41, via the fiberoptic link 71, to cause the motor device in the form of the fan 67, to vary continuously the flow rate of the air entering the mixing chamber 68 during cooling, for conditioning the air being discharged into the space 46.

As described in U.S. Pat. No. 5,005,636, the controller 41 causes a control signal to vary in a proportional manner relative to the volume of primary air available to the terminal unit 40 for conditioning the air being discharged into the space 46. The fan control 73 responds to the control signals received via the fiberoptic link 71 to provide a high voltage continuously during the pulse modulated signal via a lead 74 to a motor 75 driving the fan 67 continuously in a manner described therein.

The controller 41 generates the control signal sent via the fiberoptic link 71 to the fan control 73, in response to a set of variables. In this regard, a temperature sensor 76 disposed within the space 46 provides a signal to the controller 41, which signal is indicative of the temperature of the air within the space 46. The sensor 76 is also used for sending a desired temperature for the space 46, and for disabling an automatic shut-down feature that will be described. In this regard, an override on/off switch 77 enables an occupant (not shown) to disable or override the scheduled air conditioning and lighting functions stored within the controller 41. Thus, if a particular occupant desires to work during non-scheduled working hours, the occupant can activate lighting and air conditioning for a particular space, such as the space 46, via the on/off switch 77.

A duct 81 conveying the cool primary air under pressure into the terminal unit 40 has an air flow sensor 80 mounted thereto with an element 80A to provide an air volume signal to the controller 41. The air volume signal is indicative of the volume of cool primary air available for drawing into the terminal unit 40. The temperature of the primary air may typically be 55° F., and it mixes in the mixing chamber 68 with the return air from the return space 46 at, for example, a higher temperature.

A main air valve or damper 63A is controlled by the electric damper motor 63 in response to a signal received via the lead 63B from the controller 41. As described in greater detail in U.S. Pat. No. 5,005,636, the signal for driving the motor 63 depends on the other conditions being monitored by the controller 41.

A fiberoptic link or light conduit 65A conveys a continuous signal from the controller 41 to heating element 65. Thus, the element 65 is driven by the signal to modulate the amount of heating of the air being discharged into the space 46.

Considering the override function in still greater detail, the override function begins with an "on" operation of the computer 76A. In this regard, the computer 76A sets an override timer 41A (FIG. 2) in the controller 41 to a user defined time, typically 60 minutes. Each minute, the controller 41 subtracts one minute from the override timer. Any time the override timer is greater than 0 minutes, the occupancy mode is ignored allowing zone lighting and air conditioning to be controlled as if the mode was the OCCUPIED mode.

At the end of the override period, the controller 41 changes the occupancy mode as shown in Table III. This allows the occupants to turn on lights and air conditioning from the space 46. During normal working hours, lights and air conditioning are left on for the rest of the day. If the override timer expires during non-working hours, lights and air conditioning are turned off at the end of the override period to disable energy utilization.

TABLE III

| Timer > 0 Mode | Timer = 0 Mode |
|---|---|
| OCCUPIED | OCCUPIED |
| STANDBY | STANDBY |
| UNOCCUPIED | UNOCCUPIED |
| Occupancy Mode Ignored | |

In operation, the override may expire when the overtimer reaches zero, or alternately, the override device 77 may be connected to terminate the override period.

Figure 2:
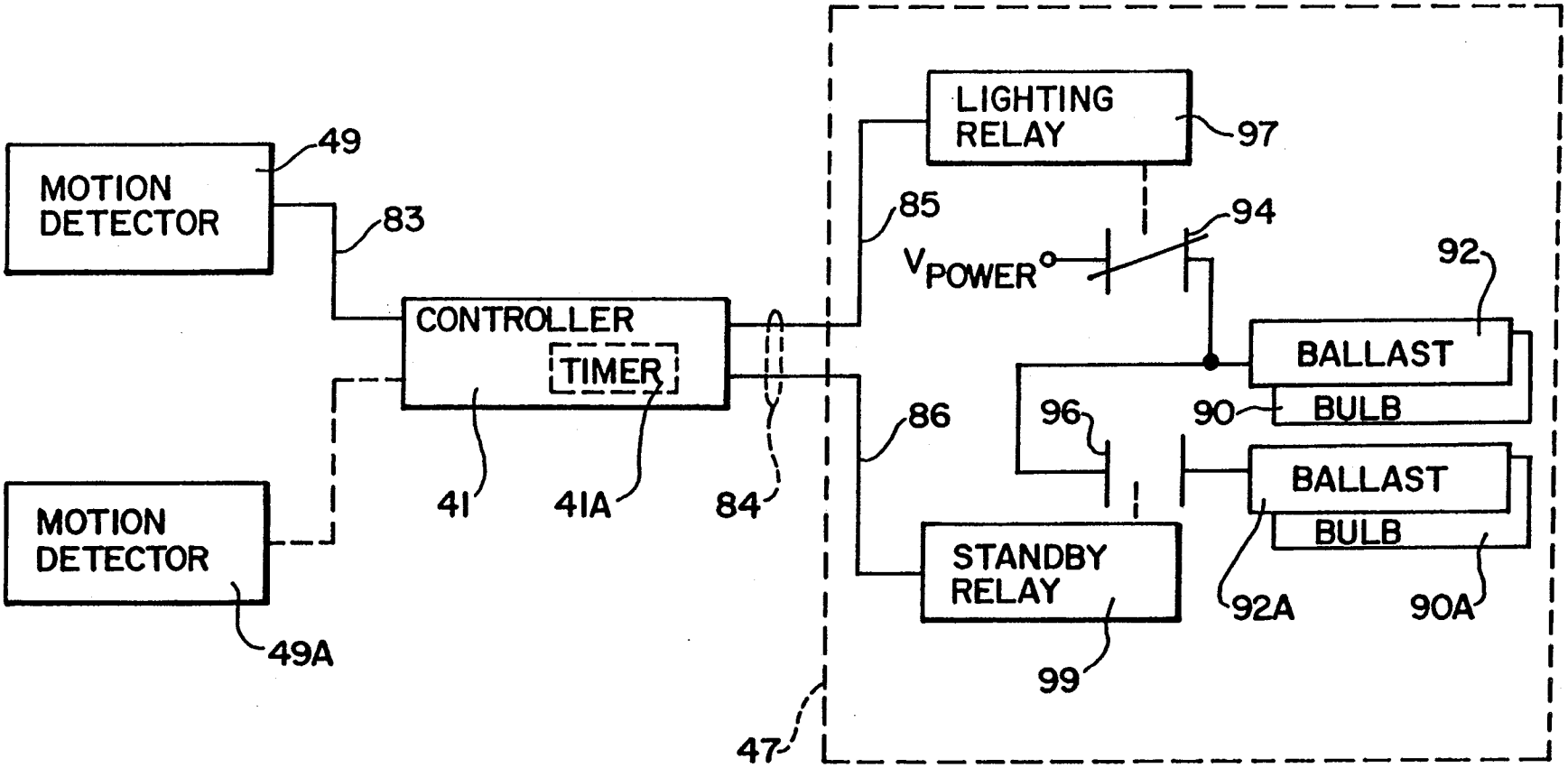
FIG. 2 is a symbolic block diagram of the lighting arrangement of the terminal unit of FIG. 1.

Considering now the lighting arrangement 45 in greater detail with reference to FIGS. 1 and 2, the lighting arrangement 45 is connected to the controller 41 by a pair of cables 83 and 84 respectively. In this regard, cable 83 is connected to the motion detector 49, while cable 84 is connected to the lighting set 47. Cable 84 includes a pair of conductors 85 and 86 for a lighting relay 97 and a standby relay 99 that will be described hereinafter Considering now the lighting set 47 in greater detail, the lighting set 47 includes a set of illumination devices, such as a fluorescent bulb 90 and 90A connected to a pair of ballast units 92 and 92A respectively. The ballast units 92 and 92A are controlled by a pair of relay 94 and 96 respectively via the lighting relay 97 and the standby relay 99. The lighting relay 97 and the standby relay 99 are connected to the controller 41 via the cable 84 and respond to the control signals generated by the controller 41. In this regard, relay 97 is a lighting relay for causing full power to be applied to the bulbs 90 and 90A when the controller 41 is in the OCCUPIED mode. Relay 96 is a standby relay for causing the bulb 90A to be extinguished, thus dimming the lighting when the controller 41 is in the STANDBY MODE.

It should be understood that if a STANDBY mode is established the lighting relay 94 will remain energized while the standby relay 96 will be de-energized. The lighting relay 94 and standby relay 96 are each 20 amp, 277 VAC ballast load relays manufactured by Staefa Control System under part No. SM2-LMAIN.

Figure 6:
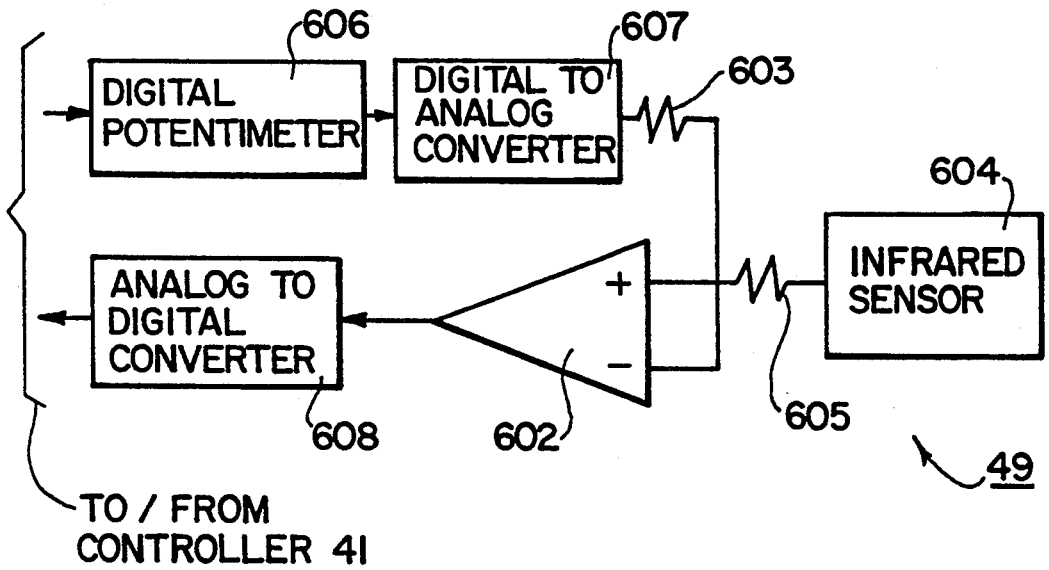
FIG. 6 is a schematic block diagram of a motion sensor of FIG. 1.

Considering now the motion sensor 49 in greater detail, the motion sensor 49 is an infrared motion sensor. The motion sensor is sold under the trademark name of Sureshot TM and is a 6250 series manufactured by Sentrol. As best seen in FIG. 6, the motion sensor 49 includes an operational amplifier 602 having its positive input connected to an infrared sensor 604 via a current limiting resistor 605. The negative input of amplifier 602 is coupled to a digital to analog converter 607 via a current limiting resistor 603. The input to the digital to analog converter 607 is controlled by a digital potentiometer 606 which, under the control of the controller 41, may be adjusted to increase or decrease the sensitivity of the motion sensor 49. An analog to digital converter 608 translates the analog output of the motion sensor 49 to a digital signal for processing by the controller 41.

Considering now the temperature sensor 76 in greater detail, the temperature sensor 76 is sold and manufactured by Staefa Control System under part number 598-63010-05.

Figure 3:
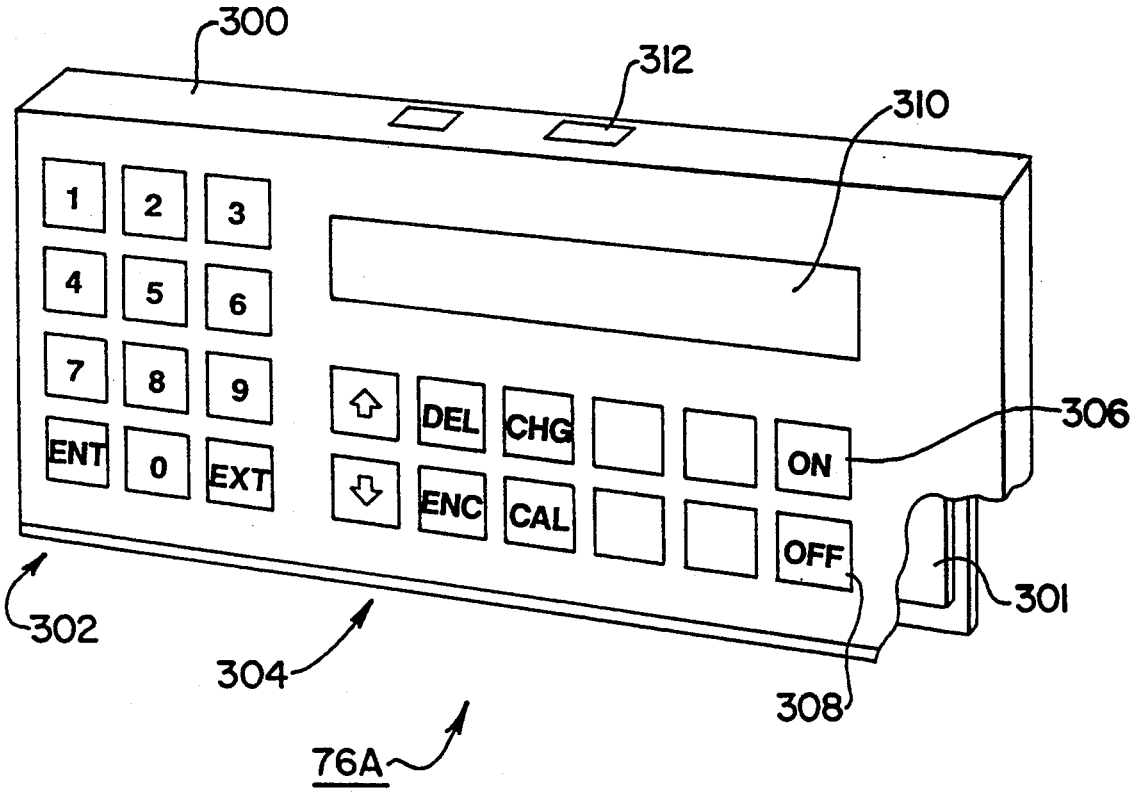
FIG. 3 is a partially cut-away pictorial view of a service tool of FIG. 1.

Considering now the service tool 76A in greater detail with reference to FIG. 3, the service tool 76A includes a housing 300, a microprocessor 301, a numeric keypad 302, and a function keypad 304 having on and off keys 306 and 308 respectively. A liquid crystal display panel 310 enables a service operator to visualize the time-out periods previously stored in the system 10 and to verify entries made via the respective keypads 302 and 304. An RS232 interface (not shown) and convention RJ12 telephone jack 312 enable the service tool 76A to be connected electrically into the temperature sensor jack 76B. The service tool is sold by Staefa Control System under part number 598-63010-01.

The scheduler program 100 which is fully described in Appendix A attached hereto includes a motion detect program 102 for override of the scheduled modes of the system 10. The motion detect program 102 will be described hereinafter in greater detail and is located in Appendix "A" under the "1 minute applications" and "input probe formulas" sections.

Figure 4:
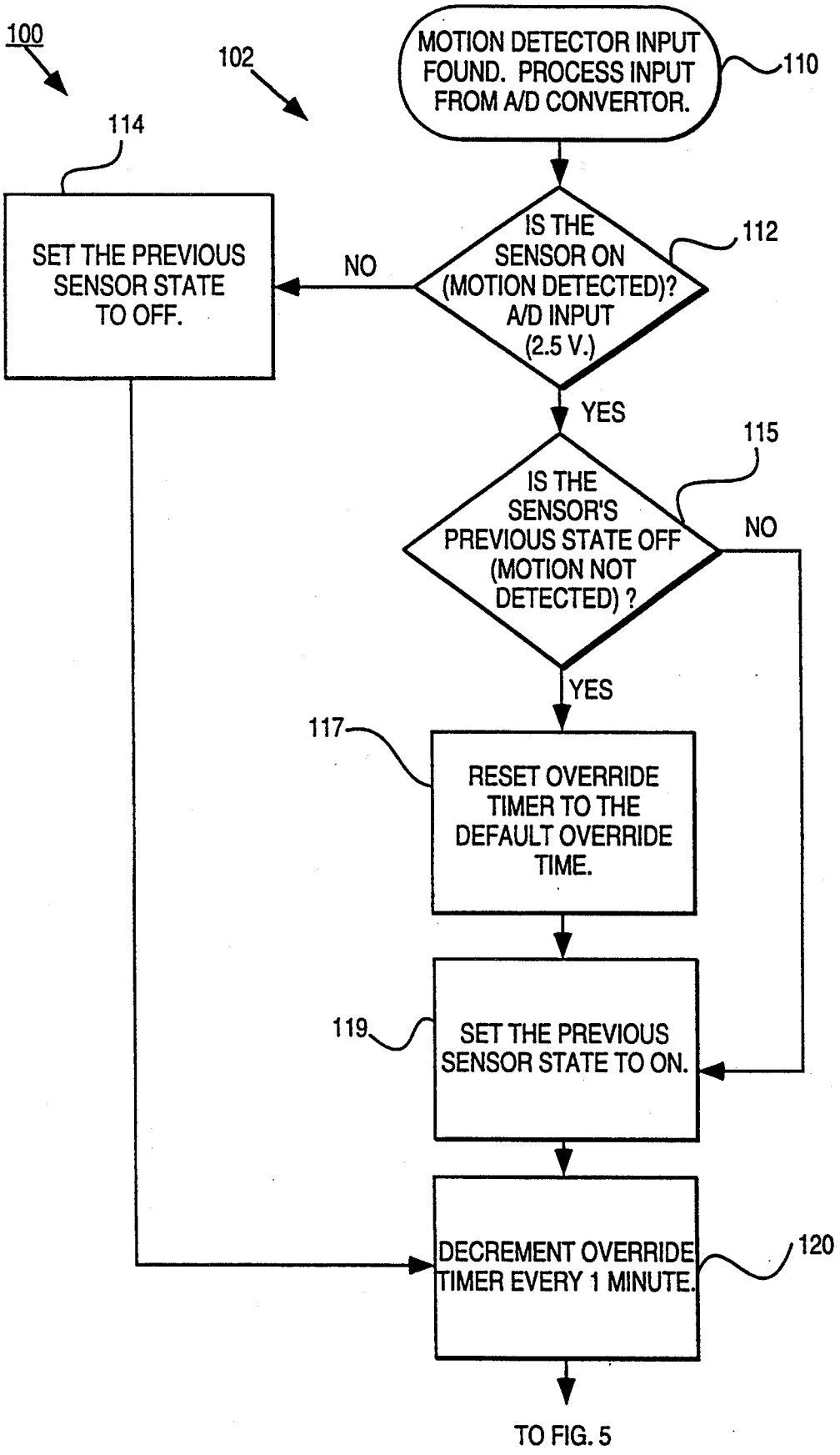
FIGS. 4–5 are flowcharts of a motion detection program for override of scheduled modes of the system of FIG. 1.
Figure 5:
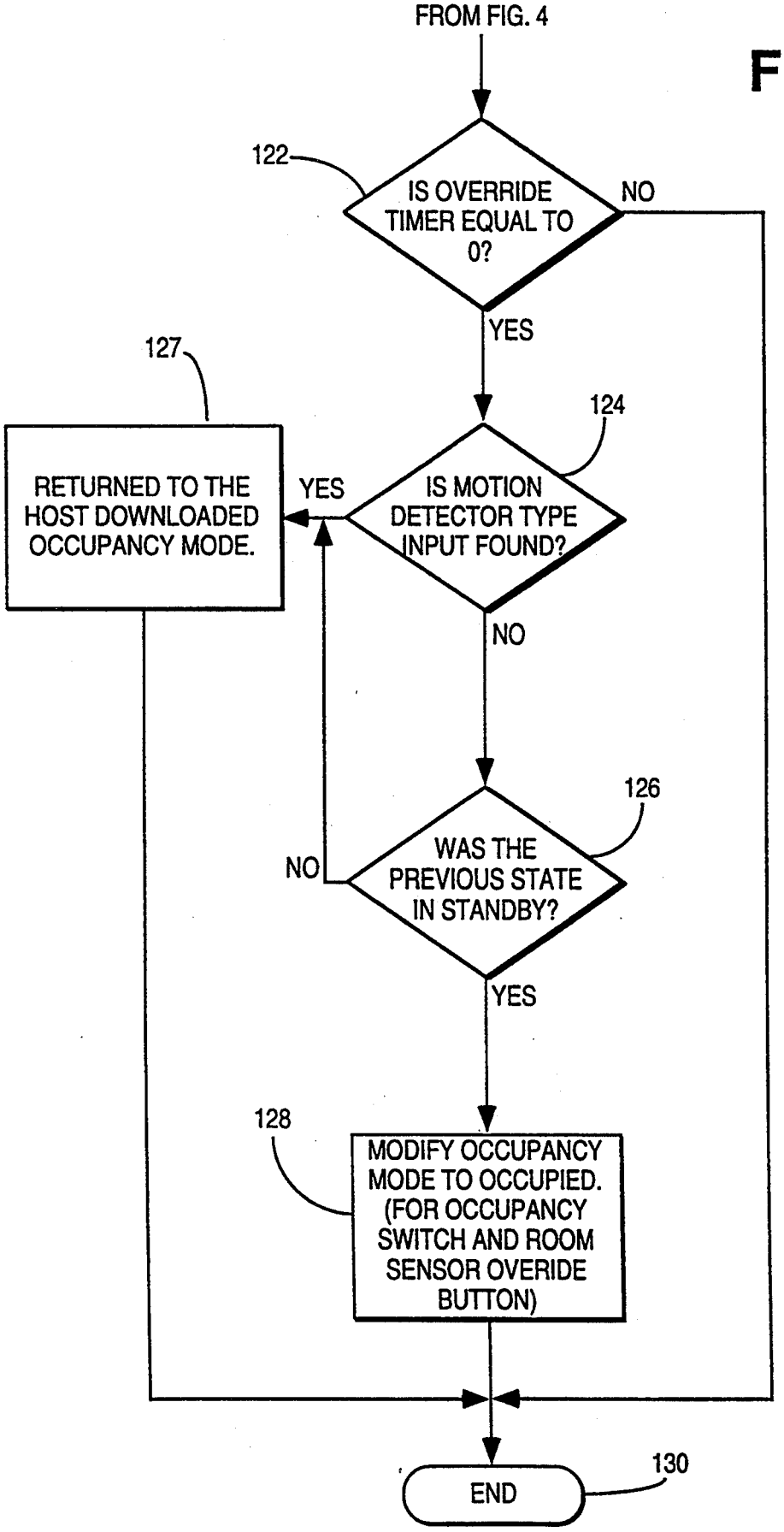

Considering now the scheduler program 100 in greater detail with reference to FIGS. 4 and 5, after the master computer 12 has downloaded a time schedule into the local controller 41, the motion detect program 102 begins at an instruction box 110 (FIG. 4) which instructs the controller 41 to process any digital signal received from the motion detector 49. The program then advances to a decision instruction 112 to determine whether or not the motion detector 49 has generated an output signal indicative of detected motion within the space, such as the space 46.

If the motion detector 49 has not generated an output signal, the program goes to an instruction box 114 which sets the previous sensor state to off. Next, the program goes to an instruction box 120 which causes the override timer 41A to be decremented once every minute.

If the motion detector 49 has generated an output signal, the program advances to a decision instruction 115 which determines whether or not the previous state of the motion sensor 49 was off indicating that motion was not detected. If the previous state of the motion sensor 49 was off, the program goes to an instruction box 117 which causes the override timer 41A to be reset to its default override time. After execution, of the command at instruction box 117, the program goes to an instruction box 119 which sets the previous sensor state to ON.

If the previous state of the motion sensor 49 was not off, the program advances to an instruction box 119 and proceeds as previously described. From instruction box 119, the program advances to instruction box 120 and provides as previously described by decrementing the override timer 41A every minute.

Next the program goes to a decision instruction 122 (FIG. 5) which determines whether or not the override timer 41A equals zero. If the timer does not equal zero, the program goes to an end instruction 130.

If the timer equals zero, the program proceeds to a decision instruction 124 which determines whether or not the motion detector type input has been found. If the type input has not been found, the program advances to a decision instruction 126 which determines whether or not the previous state of the controller 41 was the STANDBY state.

If the type input has been found, the program goes to an instruction box 127 which causes the controller 41 to be returned to the host downloaded occupancy mode. The program then advances to the end instruction at 130.

At decision box 126, if the previous controller state was the STANDBY mode, the program goes to an instruction box 128 which modifies the controller occupancy mode from the STANDBY mode to the OCCUPIED mode. The program then proceeds to the end instruction at 130.

At decision box 126 if the previous controller state was not the STANDBY state, the program goes to the instruction box 127 and proceeds as previously described.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A method for helping to minimize energy utilization within a given area comprising:

generating a detection signal indicative of motion within the given area;

activating a timer to help control energy utilization within the given area, said timer having a time out period;

enabling energy utilization within the given area in response to said detection signal;

disabling energy utilized within the given area when said time out period has elapsed;

using a zone controller for facilitating respective scheduled and unscheduled energy utilization within the area;

scheduling energy requirements within the given area;

enabling a service operator to change scheduled energy requirements within the given area remotely; and programming said timer to a specific programmable time out period to facilitate scheduled and unscheduled energy requirements within the given area.

2. In an environmental control system having conditioning means in fluid communication with a source of primary cooling and for controlling the air conditioning requirements of at least one zone within a facility, and lighting means for supplying artificial light within the zone, an energy conservation arrangement comprising:

means for generating a detection signal indicative of the presence of an occupant within the zone;

microprocessor controller means for enabling energy utilization within the zone in response to said detection signal and for disabling energy utilization within the zone in the absence of said detection signal for a given period of time;

said microprocessor controller means including zone controller means for facilitating respective scheduled and unscheduled air conditioning and lighting requirements within the zone, and remote controller means for enabling a service operator to change scheduled energy requirements within the zone remotely; and programmable retriggerable time out means having a programmable time out period, said programmable retriggerable time out means being responsive to said detection signal for causing said microprocessor controller means to control the air conditioning requirements of the zone and the lighting means to help optimize energy conservation within the zone during scheduled and unscheduled occupant activity within the zone; and wherein said given period of time is said programmable time out period.

3. In an environmental control system according to claim 2, further comprising:

override control means for overriding scheduled air conditioning and lighting requirements for a predetermined override period of time in the zone;

conductor means for helping to couple said remote controller means to said override control means; and means for mounting said override control means in close proximity to an associated small zone for facilitating override of the scheduled air conditioning and lighting requirements of the associated zone.

4. In an environmental control system according to claim 3, wherein said means for enabling includes a control console for helping the service operator to schedule the air conditioning and lighting requirements for a plurality of small zones.

5. In an environmental control system according to claim 4 wherein said override control means includes device means coupled to said remote controller means for changing scheduled air conditioning and lighting requirements.

6. In an environmental control system according to claim 5, wherein said device means includes switch means for actuating unscheduled lighting requirements within the associated zone.

7. In an environmental control system according to claim 6, wherein said override means further includes tool means for activating unscheduled air conditioning and lighting requirements within the associated zone.

8. In an environmental control system according to claim 7, wherein said tool means is computer means.

9. A control arrangement for helping to minimize energy utilization within a given area, comprising:

means for generating a detection signal indicative of motion within a given area;

retriggerable time out means to help control energy utilization within the given area, said time out means having a time-out period; and microprocessor controller means for enabling energy utilization within the given area in response to said detection signal and for disabling energy utilization within the given area when said time out period has elapsed;

wherein said microprocessor controller means includes zone controller means for facilitating respective scheduled and unscheduled energy requirements within the area;

remote controller means for scheduling energy requirements within the area;

wherein said remote controller means includes means for enabling a service operator to change scheduled energy requirements within the area remotely; and wherein said retriggerable time out means is programmable retriggerable time out means having a programmable time out period.

10. A control arrangement according to claim 9, wherein said means for generating a detection signal is motion sensor means.

11. A control arrangement according to claim 10, wherein said motion sensor means is infrared sensor means.

12. A control arrangement according to claim 9, wherein said programmable time out period is programmable to a specific period of time between about one second and about two hundred and fifty five minutes.

13. A control arrangement according to claim 12, further comprising:

adjustment means for changing said specific period of time to another specific period of time between about one second and about two hundred and fifty five minutes.

14. A control arrangement according to claim 13, wherein adjustment means is portable adjustment means adapted to be carried by said service operator.

15. A control arrangement according to claim 14, wherein said adjustment means includes keypad means for entering information into said controller means and liquid crystal display means for enabling said service operator to visualize images indicative of the information entered via said keypad means.

16. A control arrangement according to claim 9, wherein said means for enabling a personal computer means.

17. A control arrangement according to claim 9, wherein said programmable time out period is programmable to a specific period of time.

18. A control arrangement according to claim 17, further comprising:

adjustment means for changing said specific period of time.

19. A control arrangement according to claim 18, wherein said adjustment means is portable adjustment means adapted to be carried by said service operator.

20. A control arrangement according to claim 9, wherein said time-out period is reset to a new begin time out condition substantially instantaneously whenever said detection signal is generated.

21. A control arrangement according to claim 9, wherein said programmable time out period is a substantially long period of time during scheduled periods of occupancy in said given area and is a substantially short period of time during scheduled periods of unoccupancy in said given area.

* * * * *